US006978814B2

(12) United States Patent
Van Capelleveen

(10) Patent No.: US 6,978,814 B2
(45) Date of Patent: Dec. 27, 2005

(54) METHOD FOR MANUFACTURING FLOOR BOARDS

(75) Inventor: Albert Eltjo Doewe Van Capelleveen, Bleiswijk (NL)

(73) Assignee: Houtindustrie Schijndel B.V., Schijndel (NL)

( * ) Notice: Subject to any disclaimer, the term of this patent is extended or adjusted under 35 U.S.C. 154(b) by 212 days.

(21) Appl. No.: 10/131,583

(22) Filed: Apr. 24, 2002

(65) Prior Publication Data

US 2002/0152714 A1 Oct. 24, 2002

(30) Foreign Application Priority Data

Apr. 24, 2001 (NL) ..... 1017923
Oct. 26, 2001 (NL) ..... 1019242

(51) Int. Cl.[7] ..... B27M 1/08
(52) U.S. Cl. ..... 144/364; 144/365; 144/380; 409/292; 409/305
(58) Field of Search ..... 144/332, 360, 144/361, 362, 2.1, 329, 363, 364, 365; 427/274, 427/275, 290, 291, 317, 325, 363, 393, 402, 427/408, 271, 280, 241; 409/292, 305, 348

(56) References Cited

U.S. PATENT DOCUMENTS 3,017,287 A * 1/1962 Berry et al. ..... 427/382
3,081,159 A * 3/1963 Brown ..... 427/274
3,756,245 A 9/1973 Halop ..... 144/3 R
3,756,295 A * 9/1973 Halop ..... 144/4.1
3,791,427 A 2/1974 Haynes ..... 144/2 R
3,967,007 A * 6/1976 Lee ..... 427/223
4,112,144 A * 9/1978 Ellis ..... 427/223
4,558,725 A * 12/1985 Veneziale ..... 144/362
5,271,669 A * 12/1993 Pearlson ..... 312/7.2
5,271,699 A * 12/1993 Barre et al. ..... 409/132
6,660,333 B2 * 12/2003 Frame ..... 427/271

FOREIGN PATENT DOCUMENTS

| | | |
|---|---|---|
| BE | 1012020 | 4/2000 |
| CH | 602297 | 7/1978 |
| DE | 3504574 | 8/1986 |
| DE | 19754420 | 3/1999 |
| WO | 0015400 | 3/2000 |

OTHER PUBLICATIONS

English translation of Belgian Patent No. 1012020 dated Apr. 4, 2000.

* cited by examiner

*Primary Examiner*—Derris H. Banks
*Assistant Examiner*—Shelley Self
(74) *Attorney, Agent, or Firm*—Ladas & Parry LLP

(57) ABSTRACT

Method for manufacturing wooden floor boards having an antique and used look, the boards of planed new wood being subjected to a mechanical treatment for making damages in its circumferential surface, and after that to a chemical treatment of at least the entire top surface. The chemical treatment comprises the impregnation of at least the entire top surface and applying a hard wax oil after that.

25 Claims, 7 Drawing Sheets

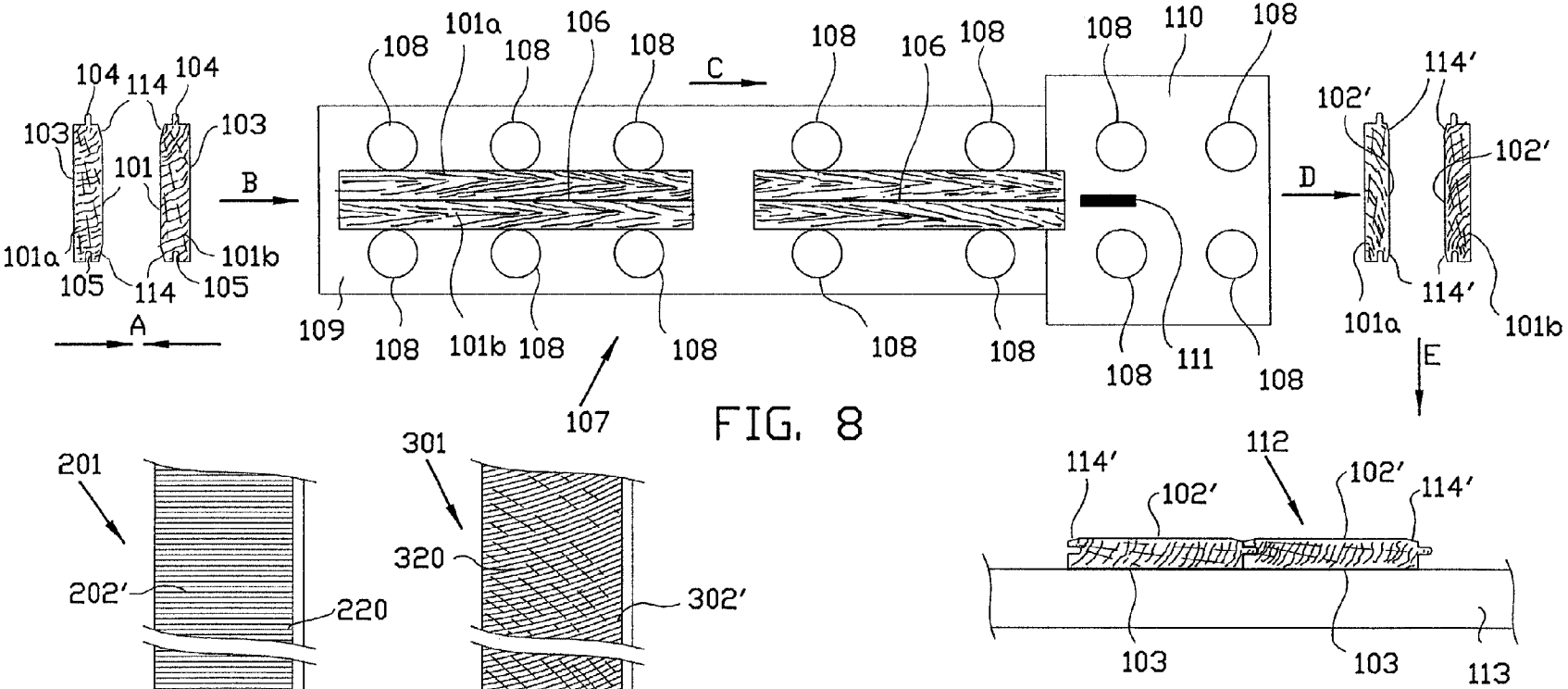
FIG. 8
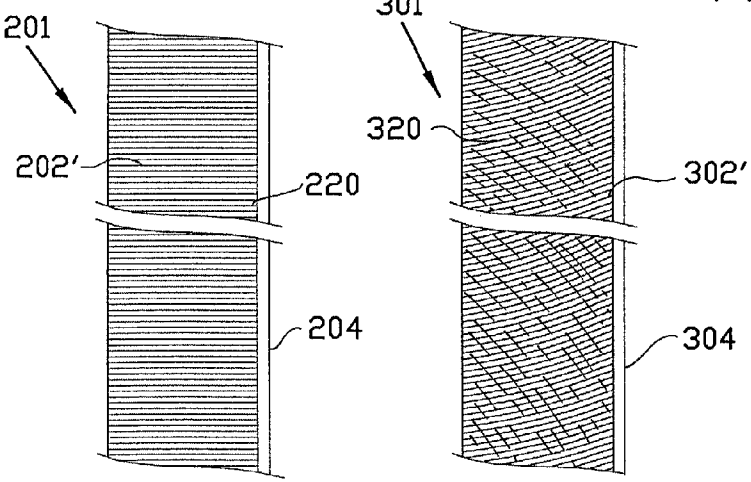
FIG. 10
FIG. 9

METHOD FOR MANUFACTURING FLOOR BOARDS

FIELD OF THE INVENTION

The invention relates to a method for manufacturing wooden floor boards having an antique or long-used look.

BACKGROUND

Many occupants wish for a home with antique or old furnishings. In addition to antique furniture an old wooden floor covering will be required to perfect an antique atmosphere. Such floors, however, are available to a limited extent, even less than antique furniture, so that genuine antique furnishings are impossible most of the time. In order to enable occupants to provide their home with an old or antique look, wooden floor boards are offered made of new wood but subjected to a mechanical ageing treatment, and also treated with a water-based colourant.

The known floor boards are placed in a stack in a vibrating container, filled with small steel parts and angular stones and the colour solution. By allowing the container to vibrate, the metal parts and the stones get in between the boards and their surfaces are being provided with damages. Simultaneously the surface is provided with a colouring all around. Said treatment is also called a wet treatment.

A drawback of the known method is that the top surface of the upper board remains smoother than the surfaces of the boards under it in the stack, and that parts of stone are left behind in the boards and metal parts get stuck in the groove at the side edge. Furthermore large damages are present in the surfaces of the boards, the boards lying more towards the bottom having more patches than the boards lying more towards the top, which may even have no patches at all. Furthermore the side edges—usually provided with tongue and groove profiles—of the boards are damaged such that they have to be planed in an additional treatment. At the edges near the top surface the boards are visibly smooth, in contrast to the top surface of the boards.

SUMMARY OF THE INVENTION

It is an object of the invention to improve at least some of these points. A further object of the invention is to provide a method of the type mentioned in the preamble, with which floor boards can be obtained which have the look of old floor boards, both in assembled, laid situation and in separate situation.

From one aspect the invention to that end provides a method for manufacturing wooden floor boards having an antique and used look, the boards of planed new wood being subjected to a mechanical treatment for making damages in its circumferential surface, and after that to a chemical treatment of at least the entire top surface.

By separating both treatments the damages are made in a dry process and the means for making the damages can be selected independent from the chemical treatment. Additionally there is freedom in the choice of chemical treatment of the (top) surface. Said treatment can be effective everywhere, also on the damaged places. After that the boards are ready for sale to the consumer and they can be laid by the consumer without any further treatment.

Preferably the mechanical treatment comprises the making of little stretched grooves, particularly transverse to the main direction of the board. This enhances an old look of the boards.

Preferably the mechanical treatment takes place by means of coarse metal parts, at least metal parts that are larger than the groove of the board to be treated, at least cannot be received in there. They do not leave visible parts behind in the treated surface. It is preferred here that use is made of metal parts that are provided with sharp tips, particularly metal parts provided with pen-shaped protrusions forming the tips.

For the grooves use can advantageously be made of elongated metal parts that are dragged along the surface of the boards.

Preferably the boards are linearly turned during the mechanical treatment, as a result of which an intensive contact with the board surface can be achieved in an efficient way.

Preferably the chemical treatment comprises the impregnation of at least the top surface of the boards.

In an embodiment this can take place with a transparent agent, in another with a white impregnation agent, depending on the desired look. By impregnation, preferably taking place with a synthetic oil, a permanent protective layer is applied. It is not objectionable when the impregnation agent contains a solvent such as white spirit, as impregnation takes place in the factory, and sufficient exhaustion can easily be ensured, which is much more difficult for a consumer.

Depending on the quality of the used wood it may be necessary to stuff holes, for instance created because a knot has fallen out. Such open defects can in an advantageous manner be removed by after impregnation stuffing open defects, such as knots that have fallen out, with a mixture of hard wax oil and fine dust, optionally with a colourant for (preservation of) contrast.

In order to perfect the old look, it is preferred that a transparent hard wax oil is applied on the surfaces of the boards, after impregnation or stuffing.

According to the invention an alternative look can be obtained when the chemical treatment comprises subjecting the boards to a vapour treatment, preferably an ammonia vapour and/or a treatment with lime water mixture, prior to impregnation. The effect will be optimal when the boards are of oak wood. A larger diversity in colours can be achieved here by variation in their intensity.

The effect is even further enhanced when the boards are subjected to a second vapour treatment after impregnation, preferably with vapour of the same kind as the vapour of the first vapour treatment and/or a treatment with a lime water mixture.

Alternatively after vapouring the boards can at least at their top surface be provided with said hard wax oil coating, as a result of which they will obtain a very dark look.

From a further aspect the invention provides a method of the above-mentioned kind, the dry boards being sawed through prior to the mechanical treatment, to be parted into two boards, the saw surface forming the top surface of both boards.

The invention further relates to floor boards and to a method for manufacturing wooden floorboards having an antique or long-used look.

Many occupants wish for a home with antique or nostalgic furnishings. In the catering industry there is also a need for such furnishings. In addition to antique furniture an old wooden floor covering will be required to perfect an antique atmosphere. Such floors, however, are available to a limited extent, even less than antique furniture, so that genuine antique furnishings are impossible most of the time. In order to enable occupants and/or owners in the catering industry to provide their home with an old or antique look, wooden floor boards are offered made of new wood but subjected to a mechanical ageing treatment.

A next object of the invention is to provide floor boards with a special, used look.

A further object of the invention is to provide a method for manufacturing such floor boards.

A further object of the invention is to provide a method of the kind mentioned in the preamble, with which floor boards can be obtained that have the look of old floor boards, both in assembled, laid situation and in separate situation.

From a further aspect the invention to that end provides a method for manufacturing floor boards having a sight side, the boards in planed and dry condition being roughened at the sight side over the entire surface through engagement with a wood removing tool.

Said method according to the invention is simple and cheap to carry out. The boards used can be planed on four sides, therefore smooth/intact, and may have already been provided with bevelled edges or groove/tongue members. The roughened sight side here forms a contrasting side in the treated board. The floor boards obtained can be laid in bond and may have a "Western" look. They form an attractive alternative for the "antique" floor boards that up until now have been commercially available.

It is noted that in the past it was known per se to make "Western" style boards, but in those cases fresh, so-called wet wood, was taken as starting point, which after "roughly" sawing the boards are planed and provided with a groove/tongue.

In a development of the method according to the invention dry boards are moved past a saw at the side of the sight side, preferably in the longitudinal direction of the boards.

In an embodiment use is made of a saw intended for solid wood, a so-called coarse saw. The pitch may be of the order of magnitude of some centimeters, for instance 3 cm.

A layer of for instance 1.5 mm may be removed by the saw. Tongues and grooves remain intact here.

In an embodiment use is made of a band or belt saw, in which way a pattern transverse to the longitudinal direction of the boards is obtained. Said pattern may give a regular, rhythmic image, particularly when the saw speed and the throughput speed is kept constant.

In another embodiment use is made of a circular saw, in which way a pattern having curved lines is obtained.

Preferably the boards are placed in pairs with the sides of the sight sides abutting, while being clamped against each other and are thus passed through the saw station where a saw is passed through both abutting sides.

In yet another preferred embodiment the dry boards are placed with their main planes abutting, while being clamped against each other and are thus passed through a saw station, where a saw is passed through both abutting main planes, the thus roughened main planes forming the sight side.

Alternatively planed—relatively thick—boards can be sawed through in longitudinal direction, parallel to the main plane, in order to form several, preferably similarly formed boards with a sight plane roughened by the saw treatment. Preferably the saw divides the boards in the middle.

From another aspect the invention provides a method for manufacturing floor boards having a sight side, dry preferably four-sided planed boards at the sight side being subjected to a rolling treatment for forming indentations with one or more indentation profiles. In this way the surface at the sight side is given a line pattern having shallow channels/facets.

Preferably the indentations are arranged continuously, so that the channels run continuously over the sight surface.

In a development thereof use is made of a roller having at least one circumferential band or strip having an indentation profile for forming an indentation, in which the band is allowed to tilt about an axis perpendicular to the sight surface. As a result it is possible to allow the channels made by a certain indentation profile to vary in direction. When the indentation profile for instance encounters a knot, the belt can tilt to a certain extent, self-piloting, and then continue making the indentation according to another path.

Preferably several indentations are arranged simultaneously adjacent to each other, by means of separately tiltable or swivelling bands. As a result the adjacent channels can have shapes that are different one from the other.

Preferably the indentation profile has a varied cross-section in circumferential direction, so that an irregular shape of the channels is enhanced.

Preferably the indentation treatment is carried out by means of a convex indentation profile, having a convexity of one or several cm.

Preferably the indentation profile has a caterpillar-shaped surface.

Preferably the board is passed along the roller in a passage which allows for an inclined position of the board or even transverse to its length.

In an advantageous embodiment the indentation treatment is carried out by means of one or more rings provided with an indentation profile, that are pressed by a roll on the sight side of the board. Preferably the roll is driven. In an advantageous manner a holder, particularly a rod, extends through the rings, which holder has a bearing surface that is situated at some (small) distance below the inner surface of the ring. As a result the rings are able to swivel about an axis perpendicular to the sight surface during the indentation-providing motion over said sight surface. Here they swivel freely within the limits, until their inner surfaces contact the said rod. The indentation profile of the rings may be caterpillar-shaped, possibly with a varied cross-section, and having a convex bulge of one or more centimeters.

Preferably the floor board is approximately 2 cm. At its lower side the floor board may furthermore be provided with longitudinal grooves to compensate for shrinkage in case they are solidly glued.

From a further aspect the invention provides a floor board with a lower surface that is unroughened, opposite the sight side.

From yet another aspect the lower surface is provided with longitudinal grooves.

From a further aspect the invention provides a floor board obtained with the method according to the invention.

From a next aspect the invention provides a floor assembled from such floor boards.

BRIEF DESCRIPTION OF THE DRAWINGS

The invention will be elucidated on the basis of a number of exemplary embodiments shown in the attached drawings, in which:

FIG. 8 is a schematic view of a first embodiment of a method according to the invention;

FIGS. 9 and 10 are floor boards obtained by means of the method of FIG. 8;

DETAILED DESCRIPTION

Figure 1:
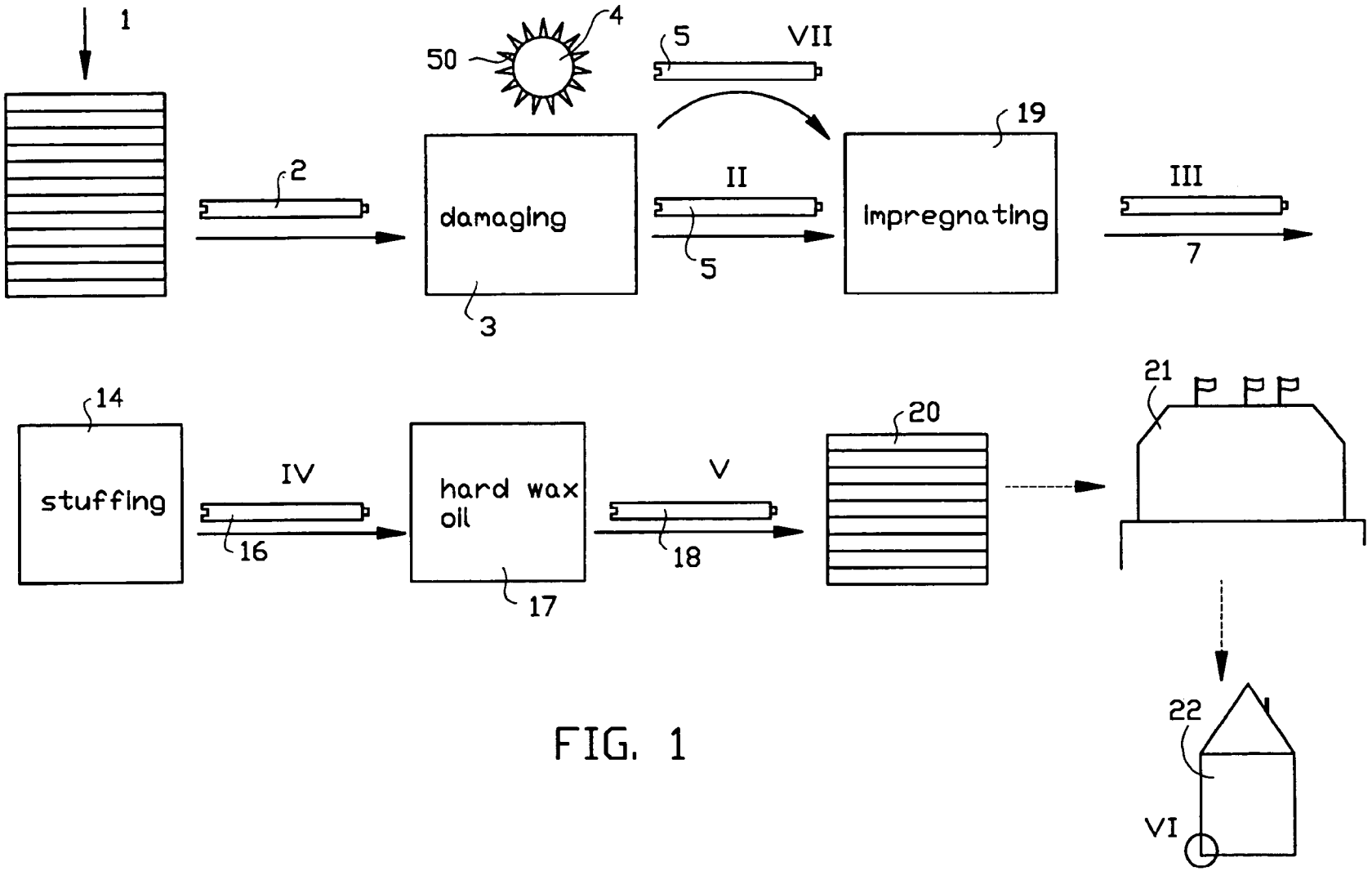
FIG. 1 schematically shows an elaborate form of a method according to the invention.

In FIG. 1, 1 indicates a stack of new (dry) boards planed, and supplied from a timber mill to the treatment factory (3, 14, 17, 19, 24).

The boards may have been sawed through in longitudinal direction parallel to the main surface—in that case mostly having straight side edges—in order to form two boards of for instance 9 mm thick. The saw cut can be made with a belt saw, with which saw lines are formed transverse to the main direction of the boards in the saw surfaces, which saw surfaces form the top surface in the further treatment. In this way a particular pattern is obtained.

Figure 2:
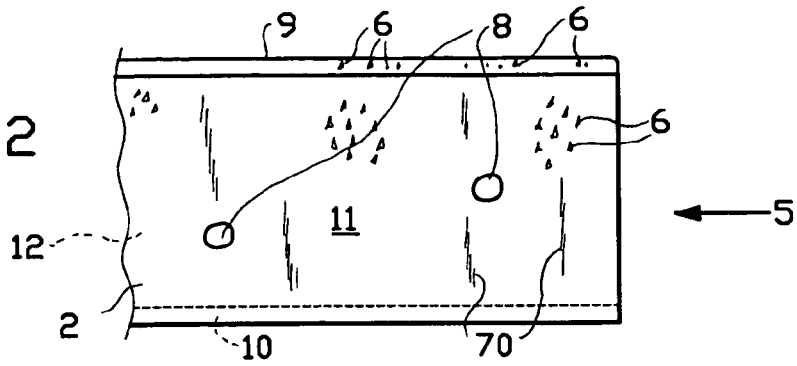
FIGS. 2–5 show floor boards in consecutive stages during the method according to the invention.

In the treatment factory the boards 2, which may or may not be provided with knots and the like, are placed in a process unit 3, where, while being linearly turned, that means revolution about a centre line parallel to the length of the boards, they are mechanically aged, that means being provided with surface damages. This may among others take place by means of metal balls 4 provided with pointy metal protrusions 50. After a while the mechanical treatment is stopped, and the boards 5 as shown in FIG. 2 have been obtained. The boards 5 in this elaborated example—just like the boards 2—have been provided with a side edge forming a tongue 9 and an opposite side edge forming a groove 10. They furthermore have a top surface 11 and a lower surface 12. The circumferential surface is formed by top surface 11, lower surface 12 and side edges 9 and 10. Due to the mechanical treatment the knots have fallen out, as a result of which holes 8 have been formed. Little holes 6 have been made by means of the tips 4, anywhere along the entire circumferential surface. Furthermore little grooves 70 have been formed, in this case perpendicular to the longitudinal direction of the boards 5, in both the top surface 11 and the lower surface 12, by means of means that are not further shown.

The boards 5 thus obtained are subjected to an impregnation treatment in station 19, in which in any case the top surface 11 is provided with a natural or synthetic oil (such as PU-impregnation agent), to which a solvent containing agent, such as for instance white spirit, may have been added. The station 19 has been provided with exhaust means for the solvents. The impregnation oil can be applied with several means, for instance a stationary brush, past which the boards 5 are guided.

Figure 3:
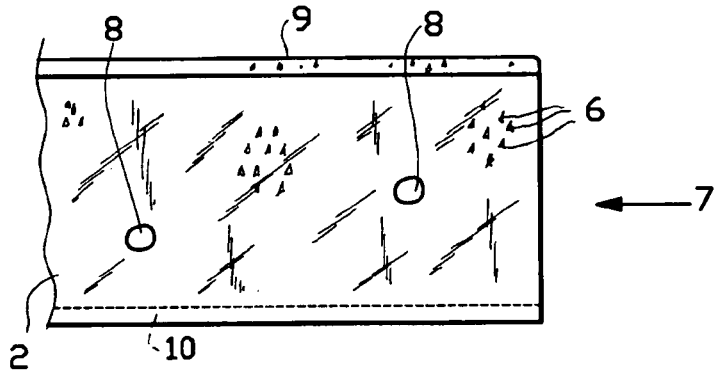

Then the board 7 shown in FIG. 3 has been obtained, still provided with holes 8. These holes are stuffed in station 14, where a mixture of fine wood dust with hard wax oil and a colourant of black and/or red lacquer, in the correct ratio, are put in the holes 8. The dark contrasting colour of said holes 8 is thus preserved, and from a distance they can hardly be discerned from real knots. The used hard wax oil is commercially available under for instance the name Floor Service Oil™ and described in DIN-standard 53160 or 68861/1a.

Figure 4:
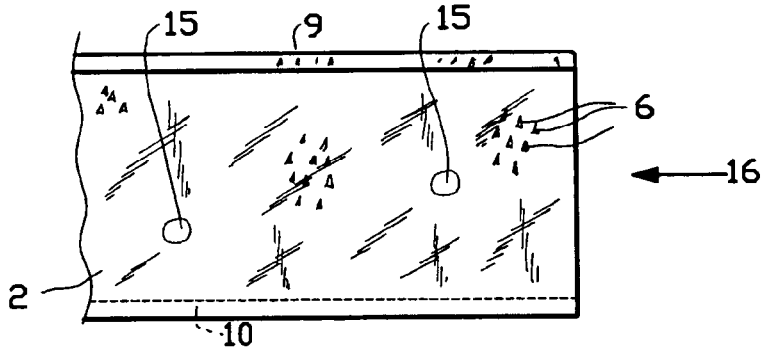

The result obtained is the board 15 with filled or stuffed holes 16 shown in FIG. 4. The board 16 depicted in there is subsequently treated in station 17, where a layer of the aforementioned hard wax oil is applied on at least the top surface 11.

Figure 5:
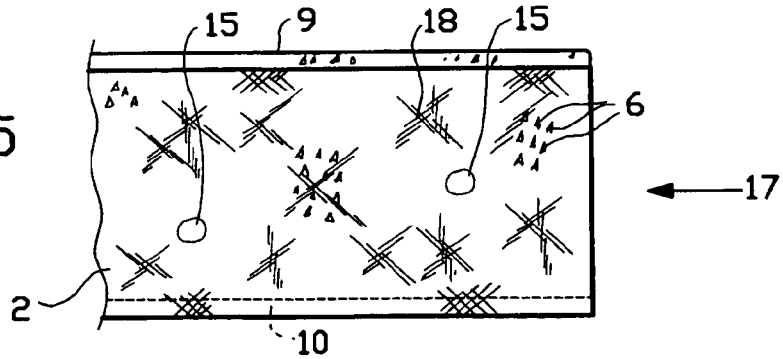
Figure 6:
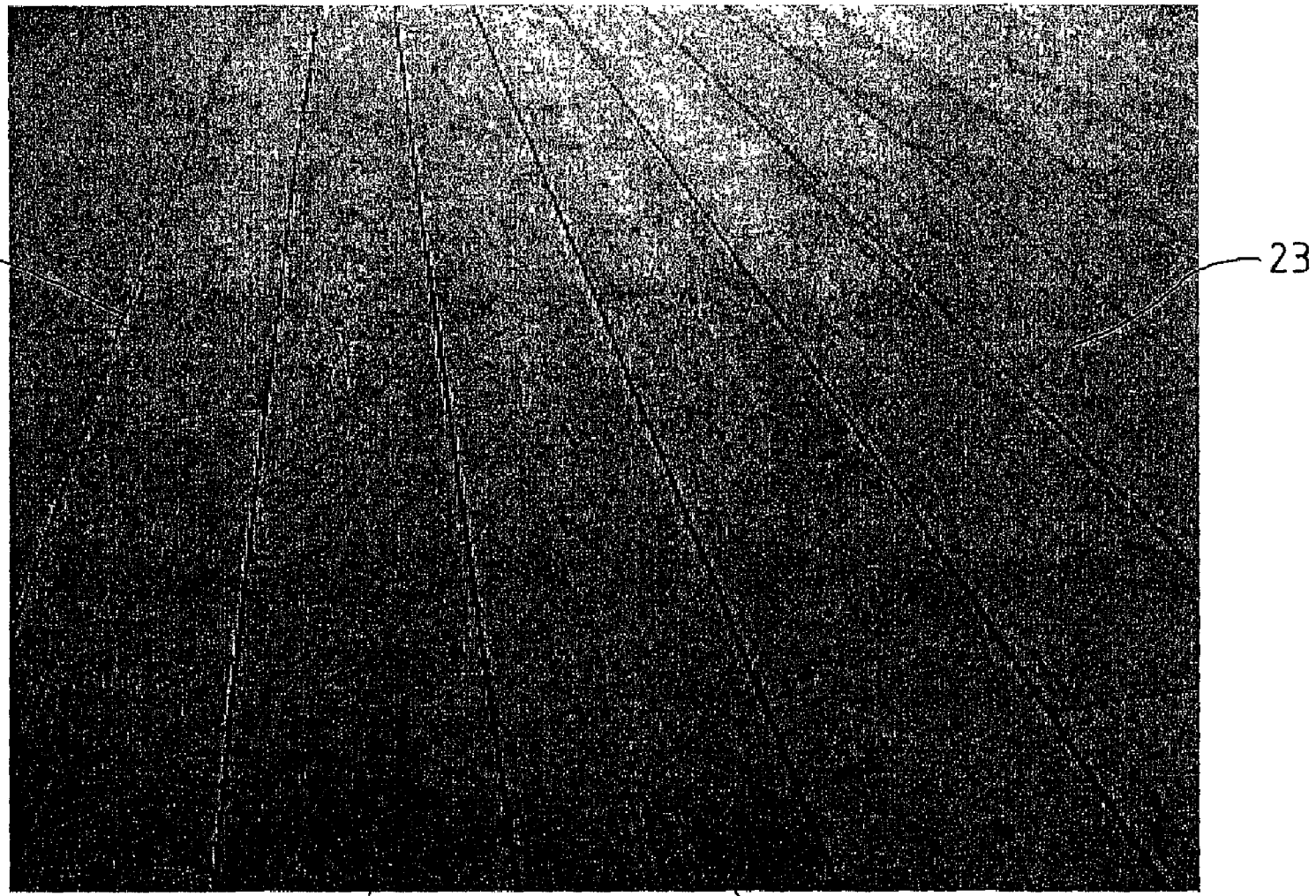
FIG. 6 shows a situation of use of floor boards obtained by means of the method of the invention.

The thus obtained board 18, shown in FIG. 5, is ready and is stacked in stacks 20. Said stacks 20 are transported from the treatment factory to a wholesaler's or retailer's 21, where the consumer can purchase them, after which the boards are transported to the consumer's house 22. The consumer only has to lay the boards in the floor of his house, without further—harmful—surface treatment. Thus the consumer has the floor 23 shown in FIG. 6, formed by in fact new boards 18, which offer a top surface which as a result of the colour scheme and the varied damages looks old and antique. Damages are also present at the location of the joint transitions 24, so that the old character of the floor 23 is not harmed there either.

Figure 7:
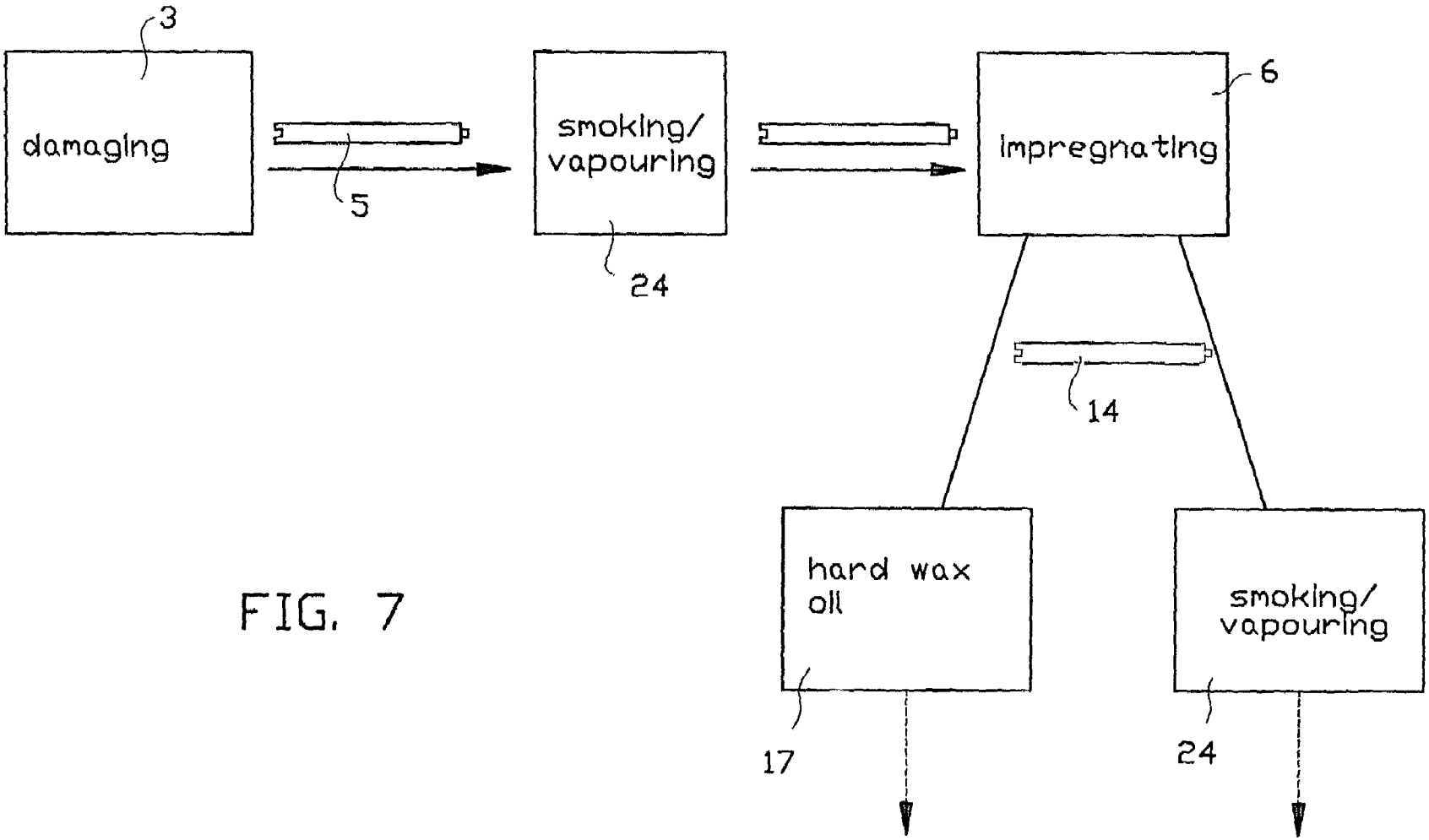
FIG. 7 is an alternative of the method.

Between the stations 3 and 19 an alternative route for the boards 5 can be followed, shown in FIG. 7. The oak wood boards 5 are subjected to a vapour treatment with vapour obtained from an ammonia solution, at the location of station 24. Not until after that are the boards subjected to the impregnation treatment in station 6. After that the boards can, if necessary, be subjected to the filling or stuffing treatment in station 14, and after that to a treatment according to station 17, to be provided with a hard wax oil layer, or be subjected again to a vapour treatment in station 24. In the latter case there is question of a double vapoured board.

In FIG. 8 a pair of new (dry) boards 101*a,b* are shown, that have been planed on four sides and have already been provided with a tongue 104 and a groove 105. The boards 101*a,b* therefore have planed flat head sides 102 and 103. At the future sight side forming head sides 102 bevelled edges 114 have been arranged at the longitudinal edges. The boards may be of oak or pine wood, or any other kind of wanted wood type, and for instance have a thickness of 20 mm.

The boards 101*a,b* are placed with the sides 102 against each other in the direction A, and (see arrow B) fed into a treatment station 107 having feeding station 109 and saw station 110. In the feeding station 109 they are in this example kept clamped against each other straight up in a package 106 and simultaneously passed through in the direction C by passage and pressing rolls 108, at least some of which being driven.

The rolls 108 transport the package 106 to the saw station 110, where a saw 111—in this example a band saw—is positioned. The package 106, permanently pressed together by rolls 108, is passed through/along the saw 111 by the rolls 108, the saw 111 being positioned such with respect to the rolls 108 that the saw 111 engages both planes 2 to an equal degree. The saw 111 is a saw suitable for solid wood, having a pitch of for instance 3 cm and having a thickness of for instance 3 mm.

A small layer, approximately half the saw thickness, is sawed off from the plane 102 by the saw 111. The planes 102' thus obtained of both boards 101 released from the saw station 110 in direction D, have a very rough pattern, having straight saw lines in traverse direction. This is schematically shown in FIG. 9, for board 201, provided with a sight side 202 engaged by the saw 111 with saw pattern 220.

Via the wholesaler's and/or retailer's, the boards 101 having roughened sight side 102' and reduced bevelled edges 114' are moved in direction E to the floor 112 of destination, where they are placed with the side 103 on floor beams 113, with the sight side 102' on top. As can be seen the tongue 104 and the groove 105 in this example are positioned slightly asymmetric, as a result of the saw treatment with the saw 111.

The saw 111 can also be formed by a belt saw, in which case the package 106 will be passed through the device 107 lying down flat: the rolls 108 will then be horizontally oriented.

Instead of a straight saw a circular saw can also be used. The pattern obtained as a result is shown in the example of FIG. 10, for board 301, having a pattern of bent lines 320 in sight side 302'.

In an alternative approach the planed boards—they usually have straight side edges—can be sawed through in longitudinal direction, parallel to the main plane by means of one of the aforementioned saws in order to form two boards that are half as thick (for instance 9 mm thick).

Figure 11A:
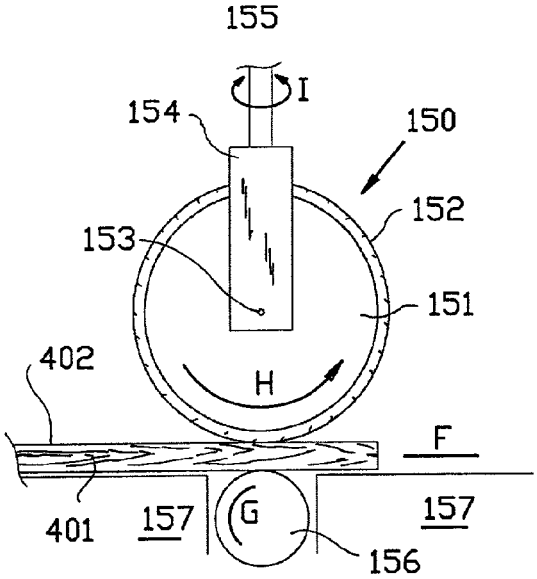
FIGS. 11A and 11B are a schematic side view and end view of a portion of a second device for a method according to the invention.
Figure 11B:
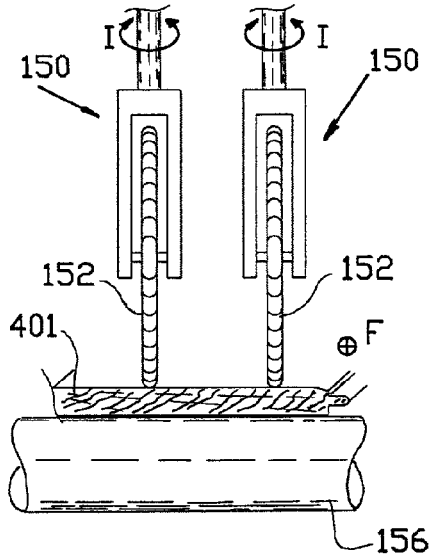

In the FIGS. 11A and 11B a part of the device has been shown with which boards 401 can be provided with special channel-shaped profiles on a sight side. The boards are supported on table 157, in an interruption of which a drive roll 156 has been placed, which is driven in the direction G for movement of the board 401 in the direction F. With the drive roll 156 and roller or wheel 151 a pinch is formed. The wheel 151 can be driven in the direction H with means that are not further shown and is pressed towards the roll 156.

Figure 11C:
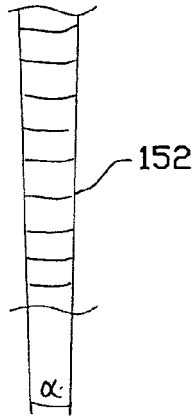
FIG. 11C is a view of a profile edge of the device of FIGS. 11A and 11B.

The wheel 151 has a convex circumferential edge 152, which, as can be seen in FIG. 11C, has a varying cross-section, the edge over the circumference running from thick to thin and back again to thick, the edge lines being at an angle $\alpha$. The profile of the edge 152 is caterpillar-shaped, so that the grip on the wood is enhanced, which is particularly advantageous when the wheel 151 is driven as well.

Figure 12:
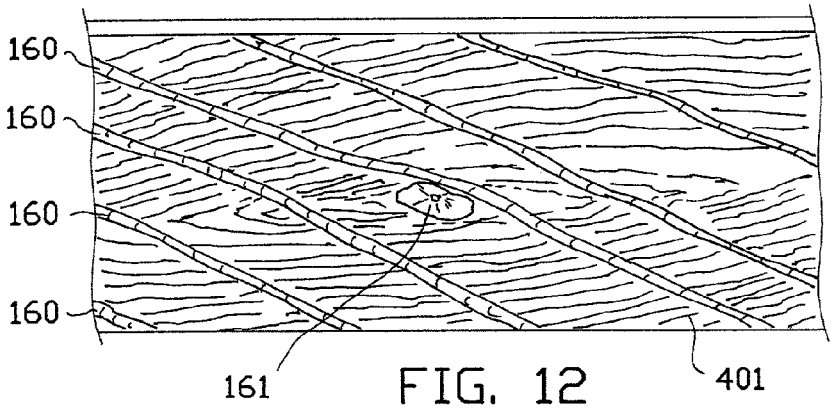
FIG. 12 is a floor board obtained by means of the device of FIGS. 11A and 11B.

The wheel 151 together with axis 153 is bearing mounted in a fork 154, the stem 155 of which is suspended in a frame that is not further shown, in which the stem 155 is freely rotatable in the direction I. As a result the wheel 151 is self-piloting, and it is able to avoid a knot 161 during the formation by indentation of the channels 160 (see FIG. 12) in the surface 402. In FIG. 12 it can clearly be seen that the various channels may have a varied course. The channels here run diagonally.

Figure 13A:
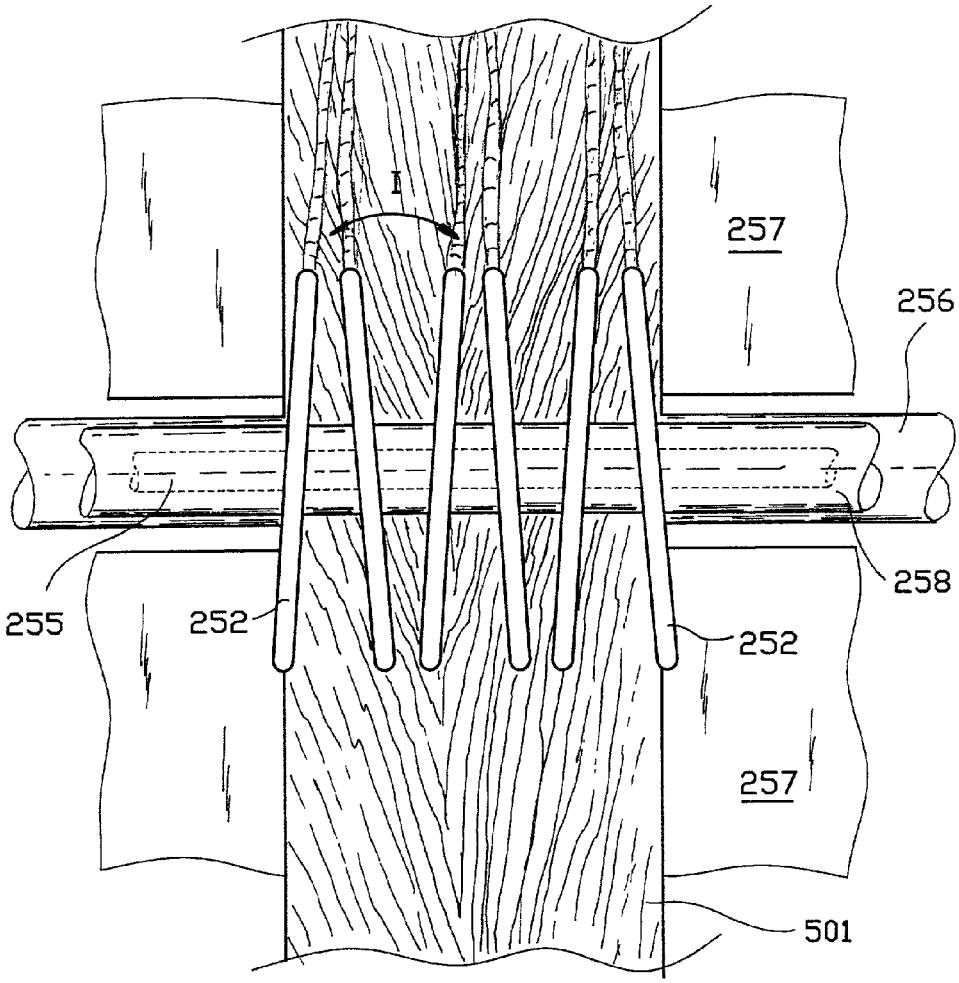
FIGS. 13A and 13B, respectively, show a top view and a side view of a preferred device for a method according to the invention.
Figure 13B:
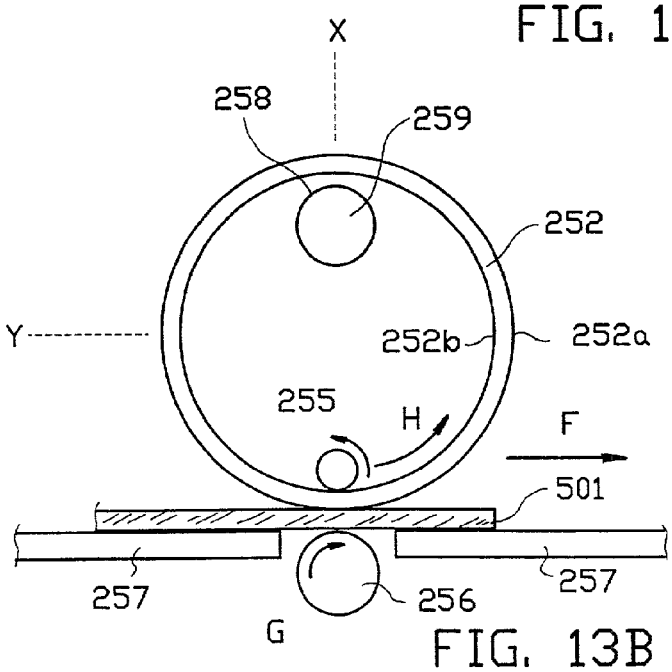

In FIGS. 13A and 13B an advantageous device is shown in a schematic way, with which also channel-shaped profiles can be made in the boards. The board 501 is supported on table 257, driven in direction G by roll 256 in the direction F. Above the drive roll 256 a driven roll 255 is situated, and above this roll a support element is situated, such as a rod 259, having a top surface 259, that is convex. With its top surface 259, the support rod 258 is situated at a small distance from the inner surface 252*b* of the rings 252. The inner surface 252*b* may be convex or flat. The outer surface 252*a* can be similarly formed to the edge 152 of the wheels 151, discussed above.

The support rod 258 ensures that the rings 252 remain more or less in their places, but as a result of said intermediate distance or slit the rings 252 may also take an inclined position, in which they tilt in the direction I. As a result they tilt about a centre line X. When the inner surface 252*b* is flat, the rings 252 remain positioned in a plane perpendicular to the sight plane of the board 501. If so desired some tilting about centre line Y can take place by giving the inner surface 252*b* some convexity. Said tilting can be limited by abutment with the upper surface 259. Several rings 252 can be placed (possibly closely) adjacent to each other, in which they can limit each other in their travel during tilting, so that a directed profile is obtained.

When no board is present the rings 252 may hang in an operationally ready position, supporting on surface 259.

By means of said method the surface 402, the sight surface, of the boards 401, that may for instance be of beech wood or oak wood, and are fed dry, and have been planed, can be given an attractive surface in one single treatment.

What is claimed is:

1. A method of manufacturing wooden floor boards having an antique and used look comprising:

providing elongated wooden boards of planed new wood having a longitudinal axis and a top surface a lower surface and longitudinal side edges, subjecting the boards to a mechanical treatment in which the boards are damaged randomly at their top surfaces, turning the boards around a center line parallel to the longitudinal axis of the boards during the mechanical treatment, and then subjecting the boards to a chemical treatment over at least the entire top surfaces thereof.

2. Method according to claim 1, wherein said mechanical treatment is covered over the entire circumferential surface comprising the top surface, the lower surface and the longitudinal side edges of the boards.

3. Method according to claim 1, wherein said mechanical treatment includes forming small stretched grooves at least in the top surfaces of the boards.

4. Method according to claim 3, wherein said small stretched grooves are formed transversely of said longitudinal axis of the boards.

5. Method according to claim 1, wherein at least one of said longitudinal side edges is formed with a groove for a tongue and groove connection, said mechanical treatment including using loose metal parts that are larger than said groove to prevent the metal parts from entering said groove.

6. Method according to claim 5, wherein said metal parts are formed with pointed projections.

7. Method according to claim 5, wherein said metal parts are formed with sharp tips.

8. Method according to claim 7, wherein said metal parts are provided with pin-shaped protrusions forming said tips.

9. Method according to claim 1, wherein said mechanical treatment comprises moving elongated metal parts along the top surfaces of the boards.

10. Method according to claim 1, wherein said chemical treatment comprises chemically impregnating at least the top surfaces of the boards.

11. Method according to claim 10, wherein the boards are impregnated with a natural or synthetic agent.

12. Method according to claim 10, wherein the boards are impregnated with a white agent.

13. Method according to claim 11, wherein after impregnation open defects including knots that have fallen out of the boards are stuffed with a mixture of hard wax oil and fine dust, optionally with a colorant for contrast.

14. Method according to claim 12, wherein after impregnation open defects including knots that have fallen out of the boards are stuffed with a mixture of hard wax oil and fine dust, optionally with a colorant for contrast.

15. Method according to claim 11, comprising applying a transparent hard wax oil on the surfaces of the boards, after impregnation.

16. Method according to claim 12, comprising applying a transparent hard wax oil on the surfaces of he boards, after impregnation.

17. Method according to claim 13, comprising applying a transparent hard wax oil on the surfaces of the boards, after stuffing.

18. Method according to claim 10, wherein said chemical treatment comprises subjecting the boards to at least one of a vapor treatment and a treatment with lime water mixture prior to impregnation.

19. Method according to claim 18, wherein the vapor treatment comprises applying an ammonia vapor to the boards.

20. Method according to claim 19, wherein the boards are made of oak.

21. Method according to claim 18, comprising subjecting the boards to at least one of a second vapor treatment and a treatment with lime water mixture after impregnation.

22. Method according to claim 21, wherein the second vapor treatment takes place with vapor of the same kind as the first vapor treatment.

23. Method according to claim 10, wherein the impregnation is made with a synthetic oil.

24. Method according to claim 1, wherein the boards are dried and sawed prior to the mechanical treatment to form two boards, the sawed surfaces forming said top surfaces of both boards.

25. Method according to claim 1, wherein the boards are dried and are subjected to an adze treatment prior to the mechanical treatment.

* * * * *